US005292123A

United States Patent [19]

Schmidt, Jr. et al.

[11] Patent Number: 5,292,123

[45] Date of Patent: Mar. 8, 1994

[54] GOLF CLUB WITH LOCKABLE HEAD TO SHAFT RELATIVE ANGLE ADJUSTMENT

[75] Inventors: Jacob H. Schmidt, Jr., Cardiff; Richard H. Hannon, Oceanside, both of Calif.

[73] Assignee: Plop Golf Company, Carlsbad, Calif.

[21] Appl. No.: 48,295

[22] Filed: Apr. 19, 1993

[51] Int. Cl.[5] ..... A63B 53/02

[52] U.S. Cl. ..... 273/80.2; 273/80 C; 273/167 G; 273/167 H

[58] Field of Search ..... 273/167 R, 77 R, 167 A, 273/167 D, 167 F, 167 G, 167 H, 80.1, 80.2, 80.3, 80.7, 80.8, 80 C, 80 B

[56] References Cited

U.S. PATENT DOCUMENTS

| | | | |
|---|---|---|---|
| 1,517,476 | 12/1924 | Tyler | 273/80.2 |
| 1,841,062 | 1/1932 | Schavoir | 273/80.3 |
| 1,982,087 | 11/1934 | Wantz | 273/80.2 X |
| 1,983,158 | 12/1934 | Young | 273/80.4 |
| 2,932,515 | 4/1960 | May | 273/80.1 |
| 3,305,235 | 2/1967 | Williams | 273/81.2 |
| 3,430,957 | 3/1969 | Andis | 273/80.1 |
| 3,519,271 | 7/1970 | Smith | 273/167 K |
| 3,601,399 | 8/1971 | Agens | 273/79 |
| 3,980,301 | 9/1976 | Smith | 273/80.2 |
| 4,927,144 | 5/1990 | Stormon | 273/80.2 X |

FOREIGN PATENT DOCUMENTS

| | | | |
|---|---|---|---|
| 900157 | 6/1990 | World Int. Prop. O. | 273/80.1 |

*Primary Examiner*—Vincent Millin
*Assistant Examiner*—Sebastiano Passaniti
*Attorney, Agent, or Firm*—Frank D. Gilliam

[57] ABSTRACT

A golf club with a shaft angularly adjustable relative to the head through selected angles. A special tool must be used to allow any angular adjustments between shaft and head. A structural stop limits the maximum and minimum angles of adjustment between the head and shaft.

12 Claims, 1 Drawing Sheet

GOLF CLUB WITH LOCKABLE HEAD TO SHAFT RELATIVE ANGLE ADJUSTMENT

BACKGROUND OF THE INVENTION

The present invention relates generally to new and useful improvements and structural refinements in a golf club and is directed more particularly to the provisions of a putter having means for permitting the adjustment of the angle of the club shaft relative to the club head in a manner so that the club can be adapted to the user rather than the user adapting to the club. Inasmuch as the individual physical characteristics and requirements of each player very so greatly, the fixedly positioned shaft of most of the popular available putters will not necessarily comfortably satisfy any two players.

In order to comply with tournament regulations of various professional golf associations, it is mandatory that the relative angle between a shaft and head cannot be adjustable during play.

Golf clubs having adjustable heads are well known and those adjustments may be various types. Examples of prior art adjustable head golf clubs employ centrally located ball joints or rotatable connections or the like to maintain club balance.

Other prior art adjustable shaft to head golf clubs have pivots between the head and shaft positioned on the distal end of the head as an extension thereof or have translatable pivots between the head and shaft. In these last mentioned clubs the club balance is changed with any selected positioning of the shaft relative to the head.

There has not been an adjustable golf club with the club balance remaining substantially unchanged with any relative angle positioning of the club shaft and head until the emergence of the instant invention.

SUMMARY OF THE INVENTION

The invention is directed to a new and unique right or left handed gulf putter in which the shaft is angularly adjustable infinitely relative to the club head through a selected range of angles. The adjustments are relative simple to accomplish using a special tool such as, a hex head screw, an allen head screw, a clutch head screw or other uniquely designed screw heads which common tools such as a phillips head or slot head drivers, wrenches or the like are unsuitable for changing the relative angle between the shaft and head of the club. The use of a special tool insures that the relative angle between the shaft and head will not be changed during play.

The angle between the head and shaft can be adjusted at a selected relative angle without changing the designed balance characteristics of the club.

An object of this invention is to provide a regulation golf club which the angle between the head and shaft can be selected between a range of different angles.

Another object of the invention is to provide a regulation golf club which the relative angle between the club head and shaft can be selected between a predetermined maximum and minimum angle without changing the designed playing characteristics of the of the club.

Another object of the invention is to provide a regulation golf club in which the relative angle between the club head and shaft can be selected between a range of angles and that selected angle can be maintained during play.

Yet another object of the invention is to provide a regulation golf club which the relative angle between the club head and shaft can be selected between a range of angles and that selected angle can be changed only with a special tool.

These and other objects and advantages of the present invention will become apparent to those skilled in the art after considering the following detailed specification in which the preferred embodiment are described in conjunction with the accompanying drawing Figures.

BRIEF DESCRIPTION OF THE DRAWING FIGURES

PREFERRED EMBODIMENTS OF THE INVENTION

Figure 1:
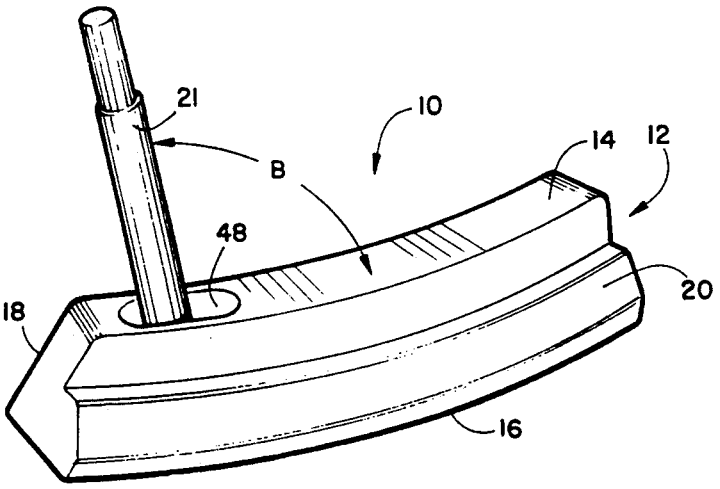
FIG. 1 is perspective showing of the golf club of the present invention.
Figure 2:
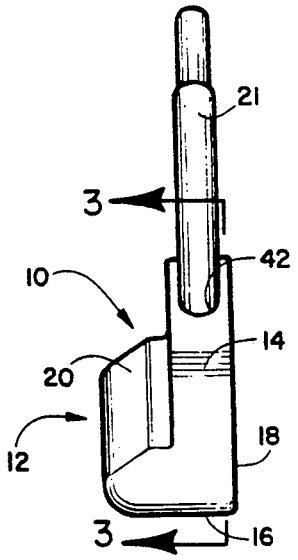
FIG. 2 is a side view showing of the golf club of FIG. 1.

Referring now to the various drawing Figures, FIGS. 1 and 2 depict a perspective showing and side view showing respectively of a golf club 10. The golf club 10 comprises a club head 12 with a curvilinear top surface 14 and a curvilinear bottom surface 16, a rectilinear ball impacting side surface 18, a slope/stepped non-ball impact side surface 20 and a shaft 21 extending from the top surface 14.

Figure 3:
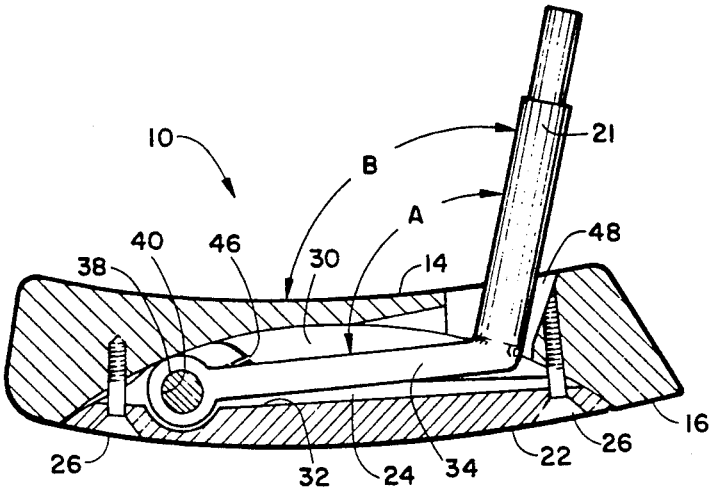
FIG. 3 is a cut away showing taken along line 3—3 of the golf club of FIG. 1.
Figure 4:
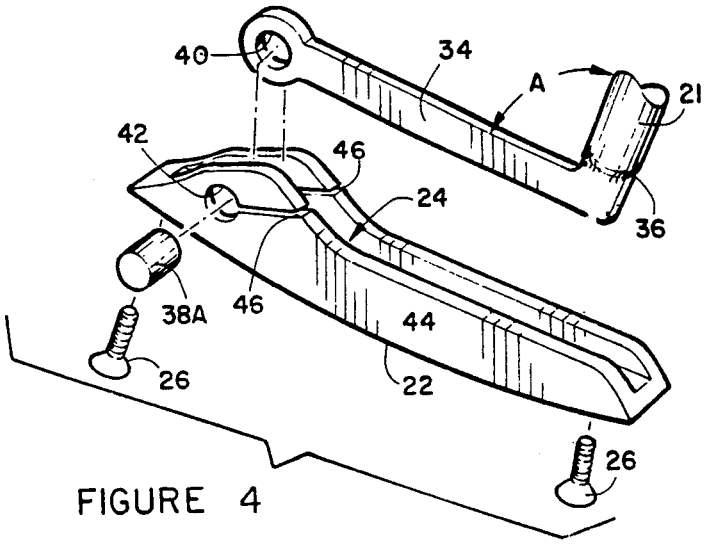
FIG. 4 is an exploded showing of the angular adjustment components of the golf club of FIG. 1.
Figure 7:
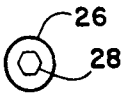
FIG. 7 is a first embodiment of the of the screw head configuration of the locking screws for seating the club head angular positioning mechanism.
Figure 8:
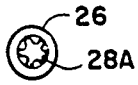
FIG. 8 is a second embodiment of the of the screw head configuration of the locking screws for seating the club head angular positioning mechanism.
Figure 9:
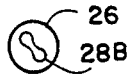
FIG. 9 is a third embodiment of the of the screw head configuration of the locking screws for seating the club head angular positioning mechanism.

Referring now to drawing FIGS. 3 and 4, the bottom surface 16 includes a removable sole plate 22 with a "U" shaped inner upstanding surfaces 24 held in place to form the bottom surface of the head by means of two special head slotted screws 26, see FIGS. 7–9. The head slots 28, 28A and 28B are utilized in a conventional manner to secure and remove the screws. The heads of the screws can take many forms such as those commonly referred to as hex, star, torque etc. as can be seen respectively in drawing FIGS. 7–9. The main consideration in determining screw head slot configuration is that a special tool be required for the loosening and tightening the sole plate 22 for adjusting and securing a selected relative angle "B" between the head and shaft. The head has a inner space 30 with a curvilinear upper surface and the bottom surface rectilinear surface 32 formed by the upper surface of the sole plate 22 when seated in place for forming the bottom surface of the club 10, see drawing FIGS. 1–3.

The shaft 21 includes an arm extension 34 fixedly attached at its distal end adjacent to the club head with a relative angle "A" between the shaft 21 and arm 34 of 90 degrees or greater. The arm extension 34 is welded or otherwise fixedly attached to the distal end 36 of the shaft. The arm extension extends within the inner "U" shaped inner surface 24 of the sole plate 22 and is fixedly attached to the arm extension and pivotly attached to the sole plate upper surface by means of a pivot pin 38, 38A or 38B, see drawing FIGS. 3, 5 and 6, extending through an aperture 40 in the distal end of the extension arm 34 and apertures 42 in the upright side walls of the "U" shaped sole plate side surfaces 44. The pivot pin 38 of drawing FIG. 4 is circular with a smooth outer surface, the pivot pin 38A of FIG. 5 has closely spaced apart teeth on the outer surface and mating teeth are provide in the apertures 40, 42 and the pivot pin of FIG. 56 is oval. The pivot pin of drawing FIG. 5 has teeth of minimal height to allow rotation for head to shaft relative angle adjustments.

The side walls 44 of the sole plate 22 includes a slot 46 from the aperture 42 to the extremities of the side walls 44 to provide a means to decrease the pivot pin receiving opening 42 as herein after explained in more detail.

The upper surface of the head 14 includes an opening 48 to allow passage of the distal end of the shaft and extension arm through the upper head surface 14 into the inner cavity of the head for attachment to the walls 44 as fore discussed. The opening in the upper surface of the head is sized to control the adjustable maximum and minimum angles between the shaft and head when the extension arm is rotated about the pivot pin.

When the relative angle between the head and club is selected, the sole plate is then seated to the head by means of two screws 26 which when seated force the upper surface of the "U" channel against the bottom inner surface of the head causing the slot 46 between the aperture in the upright side walls 44 of the "U" channel to be forced toward closure and grip about the pivot pin thereby preventing its rotation once the sole plated is seated in the bottom surface of the head thereby locking the head and shaft at the selected angle therebetween. It should be understood that when the sole plate is seated that it forms a smooth continuation of the bottom surface of the head.

Figure 5:
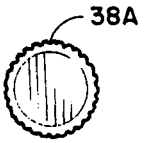
FIG. 5 is a second embodiment of the pivotal connection between the club head and shaft of the golf club of FIG. 1.
Figure 6:
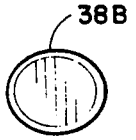
FIG. 6 is a third embodiment of the pivotal connection between the club head and shaft of the golf club of FIG. 1.

Various configured pivot pin exterior surfaces as shown in drawing FIGS. 3, 5 and 6 as well as their respective interior aperture mating surfaces may be selected to insure that the shaft angle relative to the head surface, angle "B" does not change during play.

The materials of construction may be chosen from any material which is suitable for the purpose intended examples are, stainless steel, aluminum, high impact plastic or the like materials.

While there has been shown and described preferred embodiments of the gulf club in accordance with the invention, it will be appreciated that many changes and modifications may be made therein without, however, departing from the essential spirit thereof.

What is claimed is:

1. A golf club with a shaft angularly adjustable relative to the head through selected angles comprising:

a club head having an open central area, a bottom surface and a top surface;

a removable sole plate forming a portion of the bottom surface of said club head, said sole plate having upstanding spaced apart walls extending within said club head open area;

an opening through the top surface of said head extending into said open area;

a club shaft, said club shaft having an extension arm angularly attached to a distal end, said distal end of said shaft and said extension arm extending through said opening, said extension arm having a distal end pivotably attached between said upstanding walls;

locking means at said distal end of said extension arm for preventing relative rotation between said upstanding walls and said extension arm when said sole plate is in place forming the bottom surface of said club thereby maintaining a selected relative angle between said surface of said club head and said shaft; and means for securing said sole plate in place on the bottom surface of said club head.

2. The invention as defined in claim 1 wherein the angle between said shaft distal end and said extension arm is greater than 90 degrees.

3. The invention as defined in claim 1 wherein the pivotal attachment of said extension arm between said walls comprises a pivot pin fixedly attached to said extension arm.

4. The invention as defined in claim 3 wherein said pivot pin is circular.

5. The invention as defined in claim 3 wherein said pivot pin and mating surface include meshable teeth.

6. The invention as defined in claim 5 wherein said teeth mesh with the teeth on said mating surface when said sole plate is in place on said golf club bottom surface.

7. The invention as defined in claim 3 wherein said pivot pin is oval.

8. The invention as defined in claim 1 wherein said locking means comprises an aperture through said upstanding walls for receiving a pivot pin fixedly attached to said extension arm for pivotably attaching said extension arm to said sole plate, said aperture including an elongated slot extending from said aperture to an outer surface of said upstanding walls whereby when said sole plate is seated on the bottom surface of said golf club said slot compresses for gripping said pivot pin thereby preventing relative rotation between said sole plate and side extension arm.

9. The invention as defined in claim 1 wherein said means for securing said sole plate to said golf club comprises a plurality of screws with external slots.

10. The invention as defined in claim 9 wherein said slots are in the form of a hex.

11. The invention as defined in claim 9 wherein said slots are in the form of a star.

12. The invention as defined in claim 9 wherein said slots are in the form of a torque slot.

* * * * *